US011784444B2

(12) United States Patent
Peng et al.

(10) Patent No.: US 11,784,444 B2
(45) Date of Patent: Oct. 10, 2023

(54) FULLY-SHIELDED HIGH-FREQUENCY CONNECTOR AND CONNECTOR ASSEMBLY

(71) Applicant: Electric Connector Technology Co., Ltd., Shenzhen (CN)

(72) Inventors: Bean Peng, Shenzhen (CN); Marlin Lai, Shenzhen (CN); Kevin Yin, Shenzhen (CN)

(73) Assignee: ELECTRIC CONNECTOR TECHNOLOGY CO., LTD.

( * ) Notice: Subject to any disclaimer, the term of this patent is extended or adjusted under 35 U.S.C. 154(b) by 0 days.

(21) Appl. No.: 17/827,008

(22) Filed: May 27, 2022

(65) Prior Publication Data

US 2022/0385007 A1 Dec. 1, 2022

(30) Foreign Application Priority Data

May 27, 2021 (CN) ..... 202110587426.1

(51) Int. Cl.
*H01R 24/40* (2011.01)
*H01R 103/00* (2006.01)
*H01R 9/05* (2006.01)

(52) U.S. Cl.
CPC ..... *H01R 24/40* (2013.01); *H01R 9/05* (2013.01); *H01R 2103/00* (2013.01)

(58) Field of Classification Search
CPC ..... H01R 24/40; H01R 9/05; H01R 2103/00; H01R 4/184; H01R 9/0518; H01R 13/6581; H01R 24/00
See application file for complete search history.

(56) References Cited

U.S. PATENT DOCUMENTS 6,503,100 B2 * 1/2003 Yamane ..... H01R 4/023 439/582
6,916,201 B1 * 7/2005 Chu ..... H01R 9/05 439/582
9,214,743 B2 * 12/2015 Duesterhoeft ..... H01R 24/545
9,692,149 B2 * 6/2017 Hashimoto ..... H01R 24/38
11,367,982 B2 * 6/2022 Haga ..... H01R 24/40
2015/0311602 A1 10/2015 Duesterhoeft et al.

OTHER PUBLICATIONS

European Search Report for European Patent Application No. 22175863.4, dated Nov. 8, 2022, 9 pages.

* cited by examiner

*Primary Examiner* — Briggitte R. Hammond
(74) *Attorney, Agent, or Firm* — Dickinson Wright PLLC

(57) ABSTRACT

Provided are a fully-shielded high-frequency connector and a connector assembly. The fully-shielded high-frequency connector includes an insulating base, a shell, a signal terminal and a shielding conductive stiffener. The insulating base includes an insulating body, a fitting portion and a gland portion, a first through hole structure and a second through hole structure. The signal terminal includes a contact portion, a connection portion and a mounting portion. The shielding conductive stiffener includes a tube structure, a fixing connection structure and a cover plate structure. The shell includes a main body portion, a bonding portion, a fixing portion and a snap portion. The fixing portion is electrically connected to the cover plate structure and an outer conductor of the coaxial cable. The bonding portion and the snap portion cooperate to assemble and fix the insulating base and the shell.

18 Claims, 6 Drawing Sheets

FULLY-SHIELDED HIGH-FREQUENCY CONNECTOR AND CONNECTOR ASSEMBLY

CROSS-REFERENCE TO RELATED APPLICATIONS

This application claims priority to Chinese Patent Application No. 202110587426.1 filed with the China National Intellectual Property Administration (CNIPA) on May 27, 2021, the disclosure of which is incorporated herein by reference in its entirety.

TECHNICAL FIELD

The present disclosure relates to the technical field of electrical connectors, in particular, a fully-shielded high-frequency connector and a connector assembly.

BACKGROUND

With the advent of the 5th generation mobile communication technology (5G), the signal connection between smart phones and other intelligent electronic devices can be more reliable and the speed of the signal connection can be faster. Studies indicate that the download speed of the 5G network can reach 1 GBps. To achieve the high transmission speed of the 5G network, the connection provided by radio frequency connectors is required to be more stable and the performance of the reception and transmission of the base station is required to be higher than those in the 4G. In the process of constructing the base stations of the 5G network, a large number of wireless devices need to be deployed. Since the number of the wireless devices is very large and the locations for installation and deployment of the wireless devices are very complex, the electromagnetic interference between the wireless devices easily occurs. To reduce the electromagnetic interference, high shielding performance of components in the wireless devices is required; especially, when a coaxial receptacle of the components is connected to a coaxial cable assembly or when the coaxial receptacle of the components is connected to a docking connector, the high shielding performance is required. In addition, the coaxial receptacle is also required to be miniaturized in size.

However, in the related art, the metal casing of a high-frequency connector needs to be assembled by a secondary bending process in the assembly process, so that when the high-frequency connector is in mating connection with a docking connector, a certain gap exists, which causes electromagnetic leakage and signal interference.

SUMMARY

Embodiments of the present application provide a fully-shielded high-frequency connector and a connector assembly. The fully-shielded high-frequency connector has extremely high electromagnetic shielding performance in the case of satisfying the development requirements of miniaturization of products.

To achieve the preceding object, the present disclosure adopts technical schemes described below.

A fully-shielded high-frequency connector is provided and includes an insulating base, a shell, and a signal terminal and a shielding conductive stiffener which are disposed on the insulating base.

The insulating base includes an insulating body, a fitting portion and a gland portion which are connected to the insulating body, a first through hole structure located between the insulating body and the fitting portion, and a second through hole structure located on the fitting portion.

The signal terminal is disposed between the fitting portion and the gland portion and includes a contact portion, a connection portion and a mounting portion which are disposed in sequence, where the contact portion is exposed in the second through hole structure and is configured to be in contact with a docking connector to achieve electrical connection, and the mounting portion is configured to be electrically connected to an inner conductor of a coaxial cable.

The shielding conductive stiffener is disposed between the insulating body and the fitting portion and includes a tube structure, a fixing connection structure and a cover plate structure which are disposed in sequence, where the tube structure is disposed in the first through hole structure and wraps the outside of the fitting portion, the fixing connection structure is configured to fix the shielding conductive stiffener on the insulating base, and the cover plate structure covers the upper side surface of the insulating body and is connected to the shell.

The shell includes a main body portion, a bonding portion, a fixing portion and a snap portion, where the fixing portion is configured to be electrically connected to the cover plate structure and an outer conductor of the coaxial cable, respectively, and the bonding portion and the snap portion are configured to cooperate to assemble and fix the insulating base on which the signal terminal and the shielding conductive stiffener are assembled and the shell together.

In an embodiment, the outside of the tube structure is provided with a contact bump, where the contact bump is configured to enhance contact stability between the shielding conductive stiffener and the docking connector.

In an embodiment, a first connection portion and a second connection portion are disposed between the insulating body and the fitting portion, two first through hole structures are provided and are respectively located between the first connection portion and the second connection portion, the fixing connection structure is disposed on the first connection portion, and the second connection portion is adjacent to the joint between the gland portion and the insulating body.

In an embodiment, the snap portion is located on the upper side of the fixing portion after being snapped and the snap portion is configured to reinforce connection stability between the fixing portion, the cover plate structure and the coaxial cable.

In an embodiment, the upper side edge of the tube structure is bent inward along the fitting portion to prevent warping or deformation when the fully-shielded high-frequency connector mates with the docking connector.

In an embodiment, the shell further includes a clamp portion, where the clamp portion is configured to clamp and secure the coaxial cable.

In an embodiment, the clamp portion includes a first clamp arm and a second clamp arm, where the first clamp arm is configured to directly clamp the outer conductor of the coaxial cable, and the second clamp arm is configured to directly clamp an outer sheath outside the outer conductor of the coaxial cable.

In an embodiment, the shielding conductive stiffener and the insulating base are fixed together by insert molding.

In an embodiment, the mounting portion is an annular structure, and the inner conductor of the coaxial cable is assembled in the annular structure.

A connector assembly is provided and includes any one of the preceding fully-shielded high-frequency connectors and a docking connector.

The docking connector includes a plastic base, a docking signal terminal disposed on the plastic base, and a metal casing disposed on an outside of the plastic base.

When the fully-shielded high-frequency connector is in mating connection with the docking connector, the docking signal terminal is electrically connected to the signal terminal, the metal casing is located between the shell and the tube structure, and the metal casing is in close contact with the shell and the tube structure.

REFERENCE NUMERALS LIST

Figure 1:
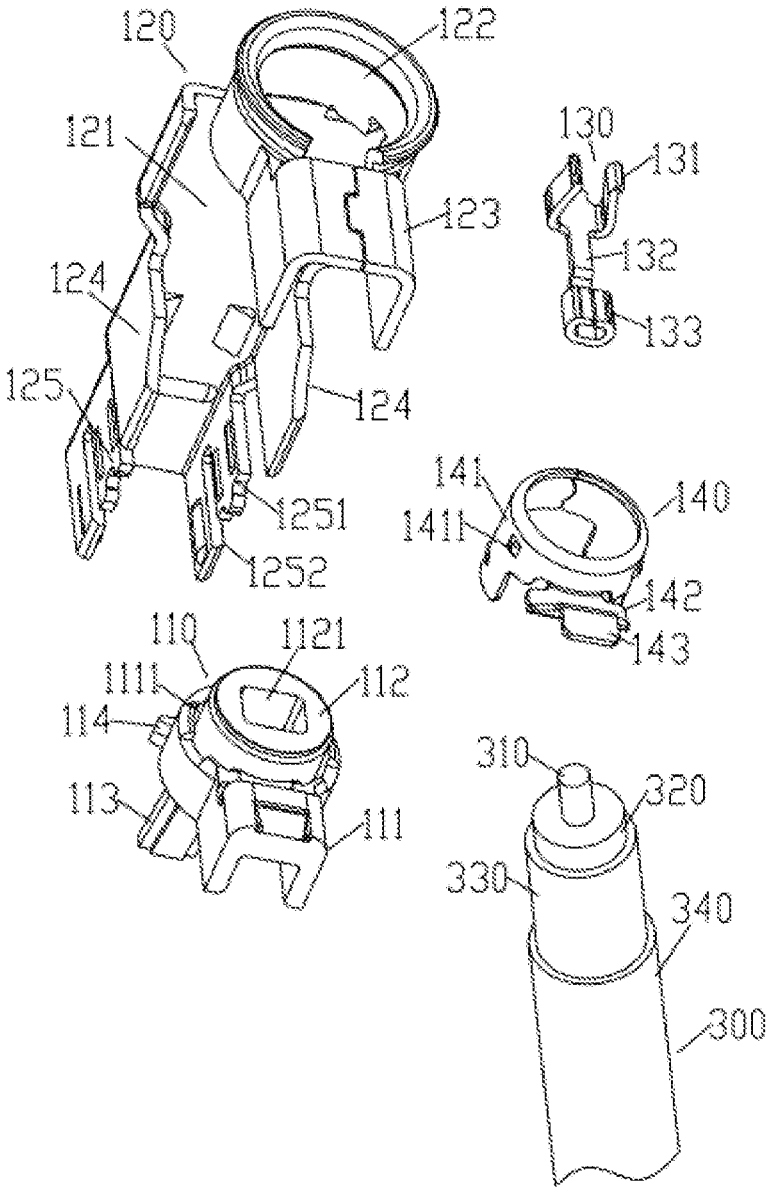
FIG. 1 is an exploded view illustrating the structure of a fully-shielded high-frequency connector before being riveted according to an embodiment of the present disclosure.

100 fully-shielded high-frequency connector
110 insulating base
111 insulating body
1111 first through hole structure
112 fitting portion
1121 second through hole structure
113 gland portion
114 positioning protrusion
120 shell
121 main body portion
122 bonding portion
123 fixing portion
124 snap portion
125 clamp portion
1251 first clamp arm
1252 second clamp arm
130 signal terminal
131 contact portion
132 connection portion
133 mounting portion
140 shielding conductive stiffener
141 tube structure
1411 contact bump
142 fixing connection structure
143 cover plate structure
200 docking connector
210 plastic base
220 docking signal terminal
230 metal casing
300 coaxial cable
310 inner conductor
320 insulating layer
330 outer conductor
340 outer sheath

DETAILED DESCRIPTION

The object, features and advantages of the present disclosure will be more apparent from the detailed description of the specific embodiments of the present application in conjunction with the drawings. Details are set forth below to facilitate a thorough understanding of the present disclosure. However, the present disclosure may be implemented in many manners different from the embodiments described herein, and those skilled in the art may make similar modifications without departing from the connotation of the present disclosure, so the present disclosure is not limited by the specific embodiments disclosed below.

The embodiments of the present application provide a fully-shielded high-frequency connector to solve the technical issue that a certain gap existing when a high-frequency connector is in mating connection with a docking connector causes electromagnetic leakage and generates signal interference. It is to be noted that above, upper or upper side in the present application refers to the side of the fully-shielded high-frequency connector in mating connection with the docking connector, and the opposite direction is below, lower or lower side.

FIG. 1 to FIG. 10 illustrates the embodiments of the present application.

Figure 2:
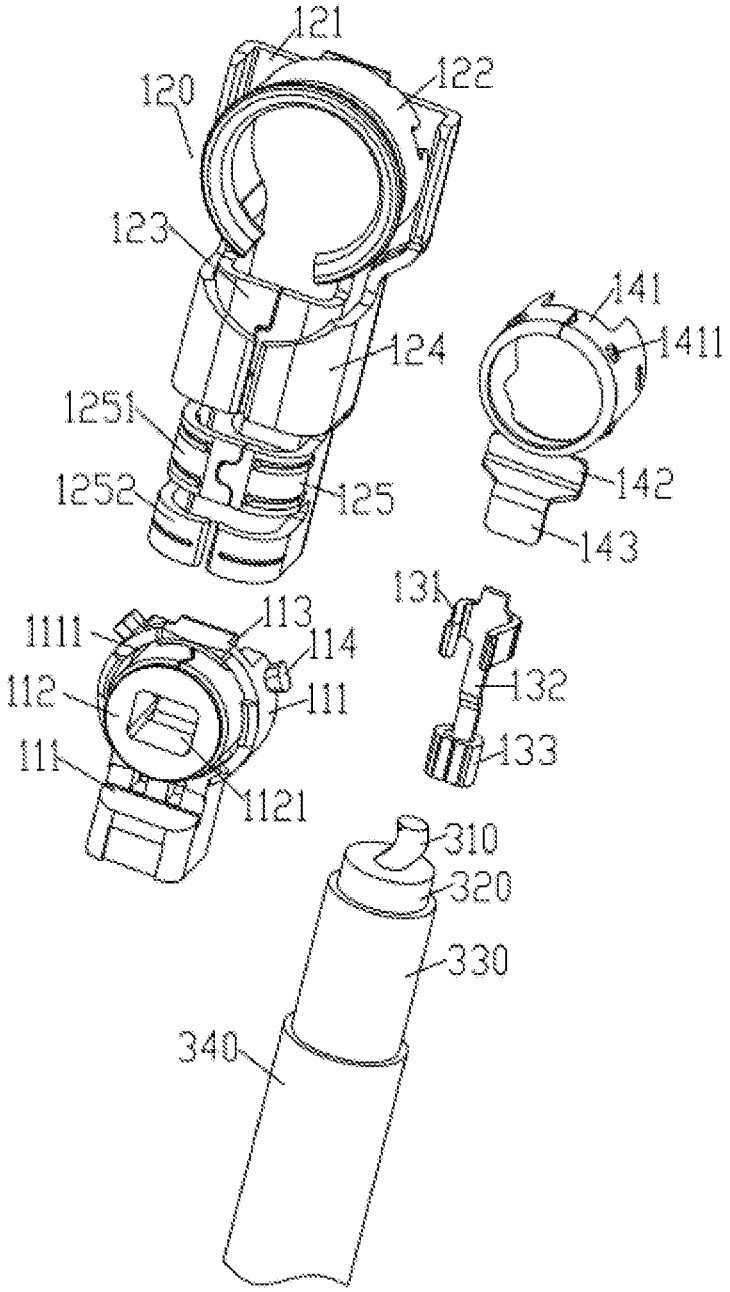
FIG. 2 is an exploded view illustrating the structure of a fully-shielded high-frequency connector after being riveted according to an embodiment of the present disclosure.
Figure 3:
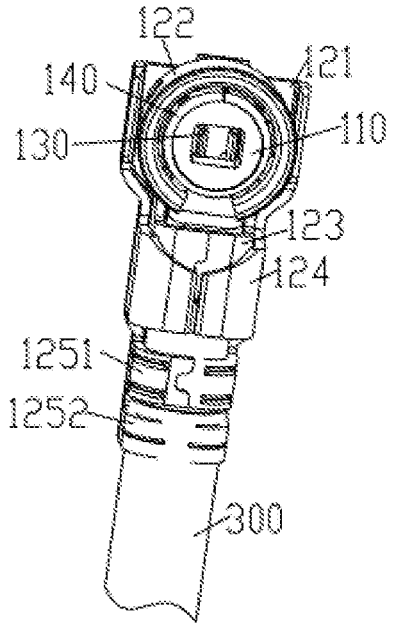
FIG. 3 is a view illustrating the structure of a fully-shielded high-frequency connector according to an embodiment of the present disclosure.

As shown in FIG. 1 to FIG. 3, a fully-shielded high-frequency connector 100 is provided. The fully-shielded high-frequency connector 100 includes an insulating base 110, a shell 120, and a signal terminal 130 and a shielding conductive stiffener 140 which are disposed on the insulating base 110. The fully-shielded high-frequency connector 100 is connected to a coaxial cable 300 when being assembled or used, and the coaxial cable 300 includes an inner conductor 310, an insulating layer 320, an outer conductor 330 and an outer sheath 340 which are disposed from the inside to the outside in sequence.

The insulating base 110 includes an insulating body 111, a fitting portion 112 and a gland portion 113 which are connected to the insulating body 111, a first through hole structure 1111 located between the insulating body 111 and the fitting portion 112, and a second through hole structure 1121 located on the fitting portion 112. The signal terminal 130 is disposed between the fitting portion 112 and the gland portion 113 and includes a contact portion 131, a connection portion 132 and a mounting portion 133 which are disposed in sequence. The contact portion 131 is exposed in the second through hole structure 1121 and is configured to be in contact with a docking connector 200 (indicated later) to achieve electrical connection, and the mounting portion 133 is configured to be electrically connected to the inner conductor 310 of the coaxial cable 300.

Figure 4:
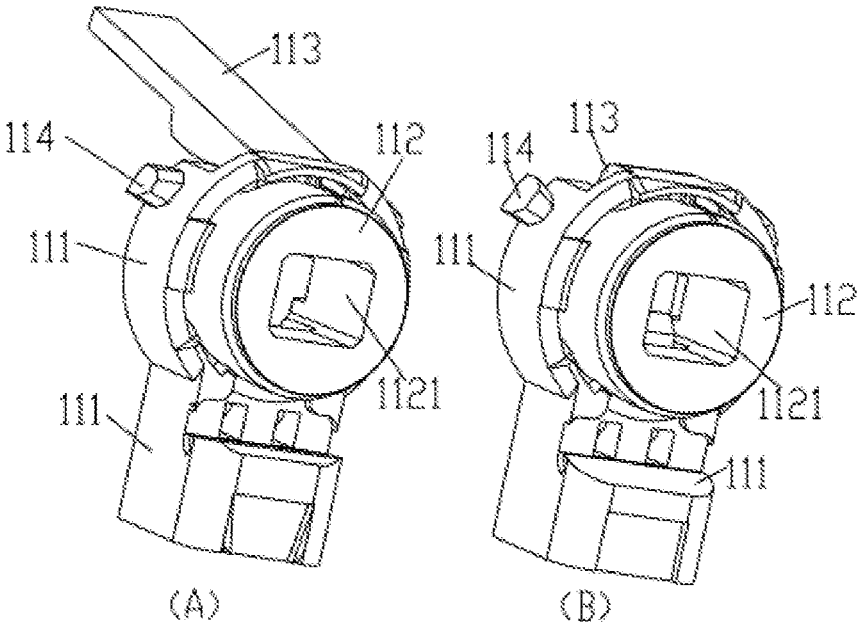
FIG. 4 is a view illustrating the structure (A) of an insulating base of a fully-shielded high-frequency connector before being snapped and the structure (B) of the insulating base of the fully-shielded high-frequency connector after being snapped according to an embodiment of the present disclosure.

As shown in FIG. 4, the gland portion 113 is movable relative to the insulating body 111. During the production and preparation of the fully-shielded high-frequency connector 100, the contact portion 131 of the signal terminal 130 is assembled on the second through hole structure 1121, the position of the connection portion 132 and the position of the mounting portion 133 on the insulating body 111 are adjusted, and the gland portion 113 is rotated, so as to fix the signal terminal 130 inside the insulating base 110.

The shielding conductive stiffener 140 is disposed between the insulating body 111 and the fitting portion 112 and includes a tube structure 141, a fixing connection structure 142 and a cover plate structure 143 which are disposed in sequence. The tube structure 141 is disposed in the first through hole structure 1111 and wraps the outside of the fitting portion 112, the fixing connection structure 142 is configured to fix the shielding conductive stiffener 140 on the insulating base 110, and the cover plate structure 143 covers the upper side surface of the insulating body 111 and is connected to the shell 120.

Figure 5:
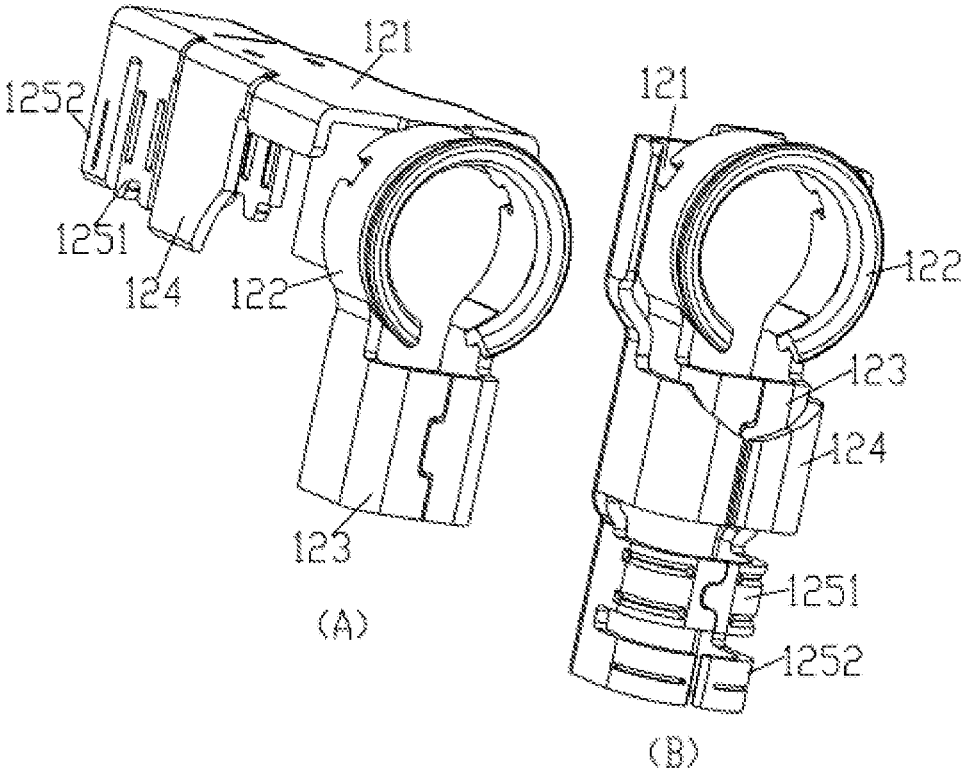
FIG. 5 is a view illustrating the structure (A) of a shell of a fully-shielded high-frequency connector before being riveted and the structure (B) of the shell of the fully-shielded high-frequency connector after being riveted according to an embodiment of the present disclosure.

The shell 120 includes a main body portion 121, a bonding portion 122, a fixing portion 123 and a snap portion 124. The fixing portion 123 is configured to be electrically connected to the cover plate structure 143 and the outer conductor 330 of the coaxial cable 300, respectively, and the bonding portion 122 and the snap portion 124 are configured to cooperate to assemble and fix the insulating base 110 on which the signal terminal 130 and the shielding conductive stiffener 140 are assembled and the shell 120 together. In an embodiment, the snap portion 124 is located on the upper side of the fixing portion 123 after being snapped and is configured to reinforce connection stability between the fixing portion 123, the cover plate structure 143 and the coaxial cable 300. As shown in FIG. 3 and FIG. 5, the insulating base 110 on which the signal terminal 130 and the shielding conductive stiffener 140 are assembled is disposed between the main body portion 121 and the bonding portion 122 for riveting, the fixing portion 123 covers and is in electrical contact with the cover plate structure 143 and the outside of the outer conductor 330 of the coaxial cable 300, and at this time, the snap portion 124 is bent or riveted to be firmly snapped on the outside of the fixing portion 123, so that the fixing portion 123 forms the stable electrical contact with the cover plate structure 143 and the outer conductor 330.

Figure 6:
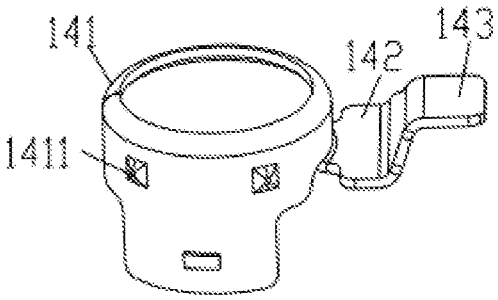
FIG. 6 is a view illustrating the structure of a shielding conductive stiffener of a fully-shielded high-frequency connector according to an embodiment of the present disclosure.
Figure 7:
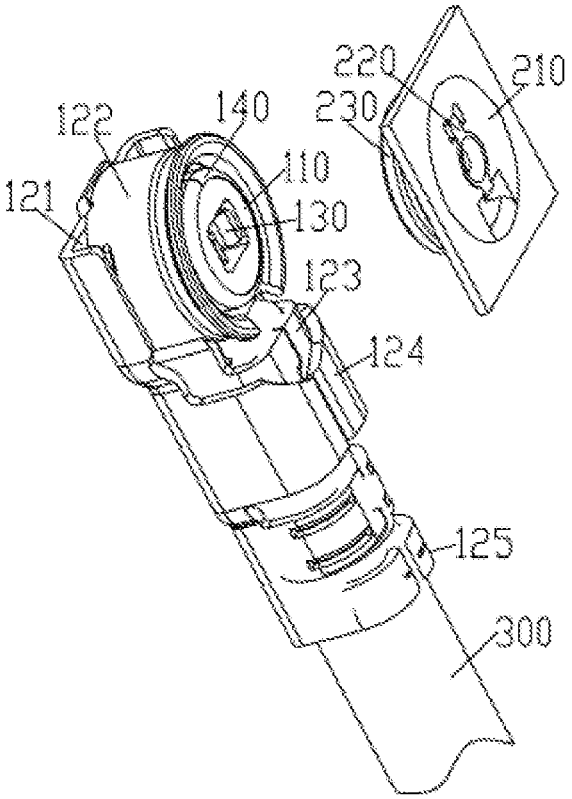
FIG. 7 is a view illustrating the structure of a connector assembly according to an embodiment of the present disclosure.

In an embodiment, as shown in FIG. 1, FIG. 2 and FIG. 6, the outside of the tube structure 141 is provided with a contact bump 1411, where the contact bump 1411 is configured to enhance contact stability between the shielding conductive stiffener 140 and the docking connector 200, so as to improve the electromagnetic shielding performance of the fully-shielded high-frequency connector 100, thereby avoiding the gap where electromagnetic leakage may occur.

In an embodiment, a first connection portion and a second connection portion are disposed between the insulating body 111 and the fitting portion 112, two first through hole structures 1111 are provided and are respectively located between the first connection portion and the second connection portion, the fixing connection structure 142 is disposed on the first connection portion, and the second connection portion is adjacent to the joint between the gland portion 113 and the insulating body 111. The first connection portion and the second connection portion are disposed, so that the connection strength between the insulating body 111 and the fitting portion 112 can be improved, and the structural strength of the insulating base 110 can be improved.

In an embodiment, a positioning protrusion 114 is further provided on the insulating body 111, and the positioning protrusion 114 is configured to tightly contact with the inner wall of the bonding portion 122 of the shell 120, so that the insulating base 110 is prevented from being scattered from the shell 120 during the riveting process, and processing and production are facilitated.

In an embodiment, as shown in FIG. 6, the upper side edge of the tube structure 141 is bent inward along the fitting portion 112, that is, the upper side edge of the tube structure 141 is in close contact with the upper side surface of the fitting portion 112, so that warping or deformation can be effectively prevented when the fully-shielded high-frequency connector 100 mates with the docking connector 200, which is conducive to improving the service life of the fully-shielded high-frequency connector 100.

In an embodiment, the shell 120 further includes a clamp portion 123. The clamp portion 125 is configured to clamp and secure the coaxial cable 300. In an embodiment, the clamp portion 125 includes a first clamp arm 1251 and a second clamp arm 1252. The first clamp arm 1251 is configured to directly clamp the outer conductor 330 of the coaxial cable 300, so that the first clamp arm 1251 is electrically connected to the outer conductor 330, and the contact area between the shell 120 and the outer conductor 330 is increased to ensure the stability of the electrical connection between the shell 120 and the outer conductor 330. The second clamp arm 1252 is configured to directly clamp the outer sheath 340 of the coaxial cable 300.

In an embodiment, the shielding conductive stiffener 140 and the insulating base 110 are fixed together by insert molding. By using insert molding, not only can the shielding conductive stiffener 140 and the insulating base 110 be firmly combined, but also the production process is simple, which facilitates the processing and production of the fully-shielded high-frequency connector.

In an embodiment, as shown in FIG. 1, the mounting portion 133 is an annular structure, and the inner conductor 310 of the coaxial cable 300 is assembled in the annular structure and is electrically connected to the annular structure. The mounting portion 133 is set as the annular structure, and the inner conductor 310 is placed in the annular structure for riveting, so that the electrical connection between the signal terminal 130 and the inner conductor 310 can be achieved while the inner conductor 310 is secured, which is easy to operate and facilitates improving the production efficiency of the fully-shielded high-frequency connector.

Figure 8:
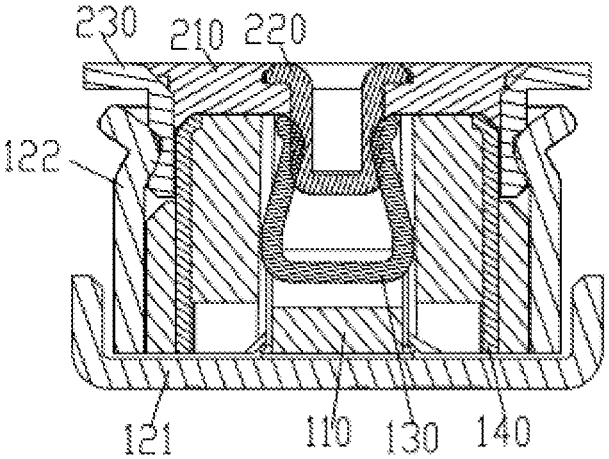
FIG. 8 is a view illustrating the transverse section of a connector assembly according to an embodiment of the present disclosure.
Figure 9:
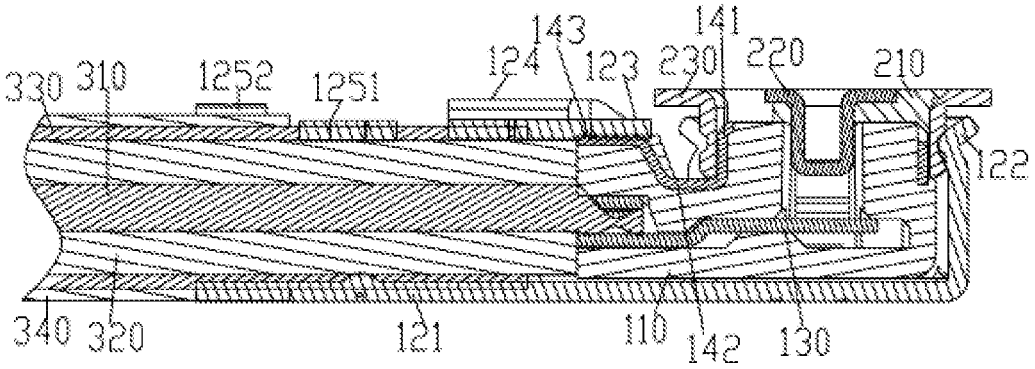
FIG. 9 is a view illustrating the longitudinal section of a connector assembly according to an embodiment of the present disclosure.
Figure 10:
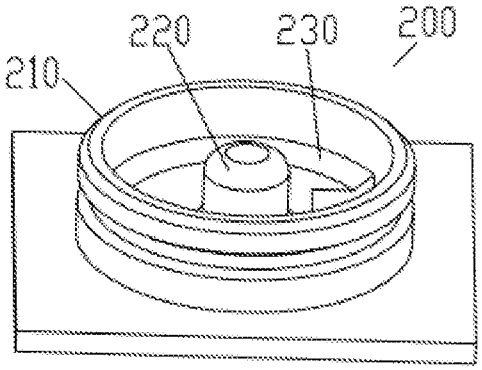
FIG. 10 is a view illustrating the structure of a docking connector according to an embodiment of the present disclosure.

The present application further provides a connector assembly including any one of the preceding fully-shielded high-frequency connectors 110 and a docking connector 200. As shown in FIG. 10, the docking connector 200 includes a plastic base 210, a docking signal terminal 220 disposed on the plastic base 210, and a metal casing 230 disposed on the outside of the plastic base 210. As shown in FIG. 8 and FIG. 9, when the fully-shielded high-frequency connector 100 is in mating connection with the docking connector 200, the signal terminal 130 is electrically connected to the inner conductor 310, the docking signal terminal 220 is electrically connected to the signal terminal 130, the shell 120 is electrically connected to the outer conductor 330, the shielding conductive stiffener 140 is electrically connected to the fixing portion 123 of the shell 120 through the cover plate structure 143, the metal casing 230 is located between the shell 120 and the tube structure 141 of the shielding conductive stiffener 140, and the metal casing 230 is in close electrical contact with the shell 120 and the tube structure 141, so that a fully-shielded space is formed. Moreover, the signal terminal 130 and the docking signal terminal 220 are located within the fully-shielded space, so that the entire connector assembly has extremely high shielding performance and thus electromagnetic signal leakage can be effectively prevented.

In the application, to solve the technical issue of signal interference caused by electromagnetic signal leakage existing in the high-frequency connector in the related art, in the fully-shielded high-frequency connector, the shielding conductive stiffener is disposed outside the fitting portion of the insulating base, so that the size of the product is not increased. In addition, when the high-frequency connector is in mating connection with the docking connector, the metal casing of the docking connector is located between the shell of the fully-shielded high-frequency connector and the tube structure of the shielding conductive stiffener of the fully-shielded high-frequency connector, and thus the signal terminal of the fully-shielded high-frequency connector and the docking signal terminal of the docking connector are located inside a fully-shielded space formed by the shell, the metal casing of the docking connector and the shielding conductive stiffener. In this manner, the shielding performance of the fully-shielded high-frequency connector is high, and thus electromagnetic signal leakage can be effectively prevented.

It is to be noted that the insert molding in the present application refers to a molding method in which a pre-prepared insert of a different material is loaded into a mold and then resin is injected, and the melted material and the insert are joined and solidified to form an integrated product.

The technical features of the preceding embodiments may be combined in any manner. For brevity of description, all possible combinations of the technical features in the preceding embodiments are not described. However, as long as the combinations of these technical features do not conflict, such combinations are to be construed as being within the scope of the specification.

The preceding embodiments are merely embodiments of the present disclosure, and the specific and detailed description thereof cannot be construed as limiting the scope of the present disclosure. It is to be noted that those of ordinary skill in the art can make a number of variations and improvements without departing from the concept of the present disclosure, and such variations and improvements are within the scope of the present disclosure. Therefore, the scope of the present disclosure is defined by the appended claims.

What is claimed is:

1. A fully-shielded high-frequency connector, comprising: an insulating base, a shell, and a signal terminal and a shielding conductive stiffener which are disposed on the insulating base, wherein the insulating base comprises an insulating body, a fitting portion and a gland portion which are connected to the insulating body, a first through hole structure located between the insulating body and the fitting portion, and a second through hole structure located on the fitting portion;

the signal terminal is disposed between the fitting portion and the gland portion and comprises a contact portion, a connection portion and a mounting portion which are disposed in sequence, wherein the contact portion is exposed in the second through hole structure and is configured to be in contact with a docking connector to achieve electrical connection, and the mounting portion is configured to be electrically connected to an inner conductor of a coaxial cable;

the shielding conductive stiffener is disposed between the insulating body and the fitting portion and comprises a tube structure, a fixing connection structure and a cover plate structure which are disposed in sequence, wherein the tube structure is disposed in the first through hole structure and wraps an outside of the fitting portion, the fixing connection structure is configured to fix the shielding conductive stiffener on the insulating base, and the cover plate structure covers an upper side surface of the insulating body and is connected to the shell; and the shell comprises a main body portion, a bonding portion, a fixing portion and a snap portion, wherein the fixing portion is configured to be electrically connected to the cover plate structure and an outer conductor of the coaxial cable, respectively, and the bonding portion and the snap portion are configured to cooperate to assemble and fix the insulating base on which the signal terminal and the shielding conductive stiffener are assembled and the shell together.

2. The fully-shielded high-frequency connector according to claim 1, wherein an outside of the tube structure is provided with a contact bump, wherein the contact bump is configured to enhance contact stability between the shielding conductive stiffener and the docking connector.

3. The fully-shielded high-frequency connector according to claim 1, wherein a first connection portion and a second connection portion are disposed between the insulating body and the fitting portion, two first through hole structures are provided and are respectively located between the first connection portion and the second connection portion, the fixing connection structure is disposed on the first connection portion, and the second connection portion is adjacent to a joint between the gland portion and the insulating body.

4. The fully-shielded high-frequency connector according to claim 1, wherein the snap portion is located on an upper side of the fixing portion after being snapped and the snap portion is configured to reinforce connection stability between the fixing portion, the cover plate structure and the coaxial cable.

5. The fully-shielded high-frequency connector according to claim 1, wherein an upper side edge of the tube structure is bent inward along the fitting portion to prevent warping or deformation when the fully-shielded high-frequency connector mates with the docking connector.

6. The fully-shielded high-frequency connector according to claim 1, wherein the shell further comprises a clamp portion, wherein the clamp portion is configured to clamp and secure the coaxial cable.

7. The fully-shielded high-frequency connector according to claim 6, wherein the clamp portion comprises a first clamp arm and a second clamp arm, wherein the first clamp arm is configured to directly clamp the outer conductor of the coaxial cable, and the second clamp arm is configured to directly clamp an outer sheath outside the outer conductor of the coaxial cable.

8. The fully-shielded high-frequency connector according to claim 1, wherein the shielding conductive stiffener and the insulating base are fixed together by insert molding.

9. The fully-shielded high-frequency connector according to claim 1, wherein the mounting portion is an annular structure, and the inner conductor of the coaxial cable is assembled in the annular structure.

10. A connector assembly, comprising a fully-shielded high-frequency connector and a docking connector, wherein the fully-shielded high-frequency connector comprises an insulating base, a shell, and a signal terminal and a shielding conductive stiffener which are disposed on the insulating base, wherein the insulating base comprises an insulating body, a fitting portion and a gland portion which are connected to the insulating body, a first through hole structure located between the insulating body and the fitting portion, and a second through hole structure located on the fitting portion;

the signal terminal is disposed between the fitting portion and the gland portion and comprises a contact portion, a connection portion and a mounting portion which are disposed in sequence, wherein the contact portion is exposed in the second through hole structure and is configured to be in contact with a docking connector to achieve electrical connection, and the mounting portion is configured to be electrically connected to an inner conductor of a coaxial cable;

the shielding conductive stiffener is disposed between the insulating body and the fitting portion and comprises a tube structure, a fixing connection structure and a cover plate structure which are disposed in sequence, wherein the tube structure is disposed in the first through hole structure and wraps an outside of the fitting portion, the fixing connection structure is configured to fix the shielding conductive stiffener on the insulating base, and the cover plate structure covers an upper side surface of the insulating body and is connected to the shell; and the shell comprises a main body portion, a bonding portion, a fixing portion and a snap portion, wherein the fixing portion is configured to be electrically connected to the cover plate structure and an outer conductor of the coaxial cable, respectively, and the bonding portion and the snap portion are configured to cooperate to assemble and fix the insulating base on which the signal terminal and the shielding conductive stiffener are assembled and the shell together;

the docking connector comprises a plastic base, a docking signal terminal disposed on the plastic base, and a metal casing disposed on an outside of the plastic base; and when the fully-shielded high-frequency connector is in mating connection with the docking connector, the docking signal terminal is electrically connected to the signal terminal, the metal casing is located between the shell and the tube structure, and the metal casing is in close contact with the shell and the tube structure.

11. The connector assembly according to claim 10, wherein an outside of the tube structure is provided with a contact bump, wherein the contact bump is configured to enhance contact stability between the shielding conductive stiffener and the docking connector.

12. The connector assembly according to claim 10, wherein a first connection portion and a second connection portion are disposed between the insulating body and the fitting portion, two first through hole structures are provided and are respectively located between the first connection portion and the second connection portion, the fixing connection structure is disposed on the first connection portion, and the second connection portion is adjacent to a joint between the gland portion and the insulating body.

13. The connector assembly according to claim 10, wherein the snap portion is located on an upper side of the fixing portion after being snapped and the snap portion is configured to reinforce connection stability between the fixing portion, the cover plate structure and the coaxial cable.

14. The connector assembly according to claim 10, wherein an upper side edge of the tube structure is bent inward along the fitting portion to prevent warping or deformation when the fully-shielded high-frequency connector mates with the docking connector.

15. The connector assembly according to claim 10, wherein the shell further comprises a clamp portion, wherein the clamp portion is configured to clamp and secure the coaxial cable.

16. The connector assembly according to claim 15, wherein the clamp portion comprises a first clamp arm and a second clamp arm, wherein the first clamp arm is configured to directly clamp the outer conductor of the coaxial cable, and the second clamp arm is configured to directly clamp an outer sheath outside the outer conductor of the coaxial cable.

17. The connector assembly according to claim 10, wherein the shielding conductive stiffener and the insulating base are fixed together by insert molding.

18. The connector assembly according to claim 10, wherein the mounting portion is an annular structure, and the inner conductor of the coaxial cable is assembled in the annular structure.

* * * * *